US010807125B2

(12) United States Patent
Burukin et al.

(10) Patent No.: US 10,807,125 B2
(45) Date of Patent: Oct. 20, 2020

(54) METHOD OF IMPELLER-DRIVEN INJECTION OF GAS IN AERODYNAMIC SEPARATOR, AERODYNAMIC SEPARATOR AND GAS BOOSTING UNIT OF AERODYNAMIC SEPARATOR

(71) Applicants: Vadym Volodymyrovych Burukin, Dnipropetrovska oblast (UA); Andriy Volodymyrovych Burukin, Zaporizhia (UA); Oleksandr Ihorovych Skladannyi, Zaporizhia (UA)

(72) Inventors: Vadym Volodymyrovych Burukin, Dnipropetrovska oblast (UA); Andriy Volodymyrovych Burukin, Zaporizhia (UA); Oleksandr Ihorovych Skladannyi, Zaporizhia (UA)

( * ) Notice: Subject to any disclaimer, the term of this patent is extended or adjusted under 35 U.S.C. 154(b) by 142 days.

(21) Appl. No.: 15/735,659

(22) PCT Filed: Feb. 24, 2017

(86) PCT No.: PCT/UA2017/000016
§ 371 (c)(1),
(2) Date: Dec. 12, 2017

(87) PCT Pub. No.: WO2017/155494
PCT Pub. Date: Sep. 14, 2017

(65) Prior Publication Data

US 2019/0060957 A1 Feb. 28, 2019

(30) Foreign Application Priority Data

Mar. 9, 2016 (UA) ..... 201602275

(51) Int. Cl.
*B07B 11/02* (2006.01)
*B07B 11/06* (2006.01)
(Continued)

(52) U.S. Cl.
CPC ..... *B07B 11/02* (2013.01); *B07B 4/02* (2013.01); *B07B 11/06* (2013.01); *F04D 19/002* (2013.01); *F04D 29/541* (2013.01)

(58) Field of Classification Search
CPC . B07B 11/02; B07B 11/06; B07B 4/02; F04D 19/002; F04D 19/29; F04D 19/44;
(Continued)

(56) References Cited

U.S. PATENT DOCUMENTS 5,032,256 A * 7/1991 Vickery ..... B07B 4/02 209/135
5,967,333 A * 10/1999 Smith ..... B07B 4/02 209/135

(Continued)

*Primary Examiner* — Charles A Fox
*Assistant Examiner* — Kalyanavenkateshware Kumar
(74) *Attorney, Agent, or Firm* — Sandy Lipkin

(57) ABSTRACT

The group of inventions can be used in agriculture as well as the food, chemical, mining, metallurgical and construction industries for the fractional separation of bulk mixtures. The group of inventions consists of a method of impeller-driven injection of gas in aerodynamic separator, wherein the gas flow is directed at an angle required for the separation process by tilting the impeller axis. Then the flow of gas is divided into inner and outer flows by an internal conical ring 5. After that the inner and outer flows are straightened by directing them through profiled blades of the inner and outer sections 6 of the stator 4. The slowdown of the flow in the center is eliminated by an exhaust cone 7. Finally, the sectional shape of the flow is changed from round to square or rectangular by passing the flow through supply channel. The proposed group of inventions also consists of a gas boosting unit 12 that is used for the implementation of the above-identified method, wherein the above-identified method and blowing unit 12 are used. The application of a group of inventions for the separation of bulk mixtures leads to a reduction in energy consumption, simplify the design of
(Continued)

nodes and improving the quality of the fractional separation of the bulk mixture.

8 Claims, 3 Drawing Sheets

(51) Int. Cl.
*B07B 4/02* (2006.01)
*F04D 19/00* (2006.01)
*F04D 29/54* (2006.01)

(58) Field of Classification Search
CPC ..... F04D 19/54; F04D 19/541; F04D 19/544; F04D 19/289
See application file for complete search history.

(56) References Cited

U.S. PATENT DOCUMENTS

2013/0092609 A1* 4/2013 Andersen ..... B03B 9/061 209/659
2013/0259667 A1* 10/2013 Huang ..... F04D 19/002 415/185
2014/0241894 A1* 8/2014 Brownell ..... F04D 29/181 416/223 R

* cited by examiner

METHOD OF IMPELLER-DRIVEN INJECTION OF GAS IN AERODYNAMIC SEPARATOR, AERODYNAMIC SEPARATOR AND GAS BOOSTING UNIT OF AERODYNAMIC SEPARATOR

REFERENCE TO PRIOR APPLICATION

This application claims priority of the Ukrainian Application Number 201602275, filed 9 Mar. 2016 and PCT application filed therefrom PCT/UA2017/000016 entitled METHOD OF IMPELLER-DRIVEN INJECTION OF GAS IN AERODYNAMIC SEPARATOR, AERODYNAMIC SEPARATOR AND GAS BOOSTING UNIT OF AERODYNAMIC SEPARATOR by Vadym Volodymyrov Burukin, Andriy Volodyrmyrov Burukin and Olaksandr Ihorovych Skladannyi.

BACKGROUND OF THE INVENTION

Field of the Invention

The field of this invention relates generally to the field of separation of bulk mixtures into uniform fractions by weight, aerodynamic shape of the particles and the particle surface properties and can be used in agriculture for the cleaning of grain and its processing products, as well as in the food, chemical, mining, metallurgical and construction industries for fractional separation of bulk mixtures.

Description of the Prior Art

It is known from the prior art the use of profiled blades to straighten the air flow after the impeller's rotor [see. SU 1150409 A, RU 2378028 C1].

The document SU 994 052 A 1 discloses a pneumatic separator, wherein the straightening of the airflow in the airduct is achieved by application of a unit in the form of a rotor with blades. Document DE 1507817 A1 discloses the device in which the swirl of flow is straightened by a node with blades and fairing. Similar elements are comprised in the device disclosed under CN 102032585 A.

In addition, from the prior art are known devices for the straightening of air flow that have profiled blades and fairing, for example those described in SU 1389878 A1 101045 UA and C2. They are used for the separation of the air flow together with bulk mixtures.

The closest in its essence is a method described in UA 70179 U in which the air flow is created in a horizontal direction by the rotation of the impeller, the swirl of flow after the impeller is eliminated by the application of the stator, the speed and direction of the gas flow is altered by passing it through the flow shapers.

The disadvantages of the known method are:

- poor performance of the stator, because of the flat shape of its blades, which, unlike the profiled blades, are not capable of removing the swirl of the gas flow;
- significant aerodynamic drag of the gas boosting unit due to the formation of turbulent areas behind the rotor's hub and in the area of an abrupt transition of the boosting unit cross-section shape from round to square, as well as due to the use of air flow shapers, which reduce the open area of the boosting unit outlet;
- significant difference in the velocity of the gas flow at the outlet of the gas boosting unit, caused by the displacement of the flow towards the swirl, slowdown in the center area and in corners due to the existing turbulent zones.

The device which employs a method being substantially closest to the implementation of the above-identified method is the device for the separation of bulk mixtures (see. Patent UA 74087 U), which consists of a housing, comprising a feeder, a separation chamber with a reflector and receivers of separated fractions with adjustable input, the front part of which is connected to a working unit which forms the airflow in the horizontal plane and then changes and its direction with the use of a flow shaper, which directs the flow of gas at the needed angle to the horizontal plane. The working unit of the device covered by UA 74087 U includes an electric motor, an impeller with a rotor mounted on the motor's shaft, a stator coupled to the electric motor, static pressure chamber and the flow shaper, installed sequentially.

The disadvantage of the known gas boosting unit is the unevenness of flow in the cross-section and the swirling of generated flow fed into the separation chamber, which leads to inhomogeneity of the separated fractions. In addition, the known device is characterized by the complexity of the design and the associated increase in electricity consumption.

The need of the gas flow straightening in aerodynamic separators arises due to the fact that the precise separation of the bulk mixture with particles having different weight into homogeneous fractions requires that such bulk mixture should be passed through a gas flow that moves linearly, without swirling, and at even velocity throughout the whole cross-section of the flow.

At the same time, the gas flow created by the impeller is swirled, i. e. is twisted in the direction in which the blades rotate. Furthermore, the velocity of the gas flow created by the impeller is not uniform across the cross-section of the flow, and increases from the center to the edges. Also, the gas flow must be fed into the separation chamber at a certain angle to the horizontal plane, which is critical for optimum separation of particles of the bulk mixture into fractions. Thus, the gas flow generated by the impeller is not suitable for ensuring the good quality of the separation of the bulk mixture.

To ensure the straightness and uniform velocity of gas or gas mixture (e.g. air) across the cross-section of the flow before it enters the separation chamber, it is necessary to eliminate the swirling of the flow, balance different velocity of gas or the gas mixture across the flow's cross-section and direct the gas flow at the required angle to the horizontal plane.

The reason for the development of a new gas boosting unit were the results of air velocity measuring at the outlet of a known gas boosting unit (see UA 74087 U). Substantial deviations from the calculated velocity of gas flow were detected across the whole section. At some points measured flow rates differ from calculated ones by 60%. Models built in SolidWorks Flow Simulation software environment confirmed the obtained results.

The proposed group of inventions resolve the following tasks: simplification of design and improvement of reliability of the gas boosting unit of the aerodynamic separator; reduction of energy consumption for the separation process, reduction of weight and size of the gas boosting unit and aerodynamic separator as a whole; ensuring evenness of velocity across the section and density of a gas flow exiting the gas boosting unit of the aerodynamic separator; increase of homogeneity of fractions separated by aerodynamic separator.

The tasks outlined above are resolved by the proposed group of inventions as follows.

SUMMARY OF THE INVENTION

The basic embodiment of the present invention teaches a method of impeller-driven injection of gas in the aerodynamic separator, according to which a flow of gas or gas mixture is generated by rotation of the impeller, straightened and aligned by the stator and fed into the separation chamber, characterized in that the flow of gas or gas mixture is fed to the separation chamber at the required angle by setting the axis of rotation of the impeller at the respective angle to the horizontal plane.

After that, the flow of gas or gas mixture generated by the impeller is divided into inner and outer flows using the internal conical ring of the stator which narrows down in the direction of the flow of gas or gas mixture.

Next, the flow of gas or gas mixture in the outer section is straightened by passing it through the profiled blades of the outer section of the stator and slowed down by increasing cross-sectional area of the outer section.

At the same time the flow of gas or gas mixture in the inner section is straightened by passing it through the profiled blades of the inner section and accelerated to a speed equal to the flow speed in the outer section by reducing the cross-sectional area of the inner conical ring and applying of fairing of conical shape (exhaust cone), installed in the center of the stator coaxially with the impeller.

One of the embodiments of the method provides that the flow of gas or gas mixture is generated by the impeller, the axis of which is at an angle to the horizontal plane in a range from 0 degrees to 60 degrees.

Another embodiment of the method provides that the shape of the cross-section of the straightened flow of gas or gas mixture is changed from circular to square or rectangular, by passing it through the supply channel which has the shape of a confuser with a smooth transition from a circular cross-section to a square or rectangular cross-section at the end of channel, where the flow of gas or gas mixtures enters the gas boosting unit.

The gas boosting unit of the aerodynamic separator, intended for the realization of the above-mentioned method, comprises a housing, a drive, a working unit in the form of an impeller (rotor), a stator and a gas flow feeding channel. Gas boosting unit has the stator mounted coaxially with impeller and designed as a device that has an inner conical ring, which narrows down in the direction of gas flow movement, and forms the inner and outer sections of the stator. The stator of the gas boosting unit also has profiled blades installed in the inner and outer sections of the stator and an exhaust cone installed in the center of the inner section coaxially with the impeller.

In accordance with one of the embodiments of the gas boosting unit, the diameter of the inner conical ring is determined depending on the ratio between the outer diameter of the impeller and the diameter of its hub, and on the distribution of the axial and tangential velocity of the gas flow along the radius of the blade.

In accordance with one of the embodiments of the gas boosting unit the angle of the narrowing of the internal conical ring of the stator is determined within a range of 2 to 25 degrees, depending on the ratio between the outer diameter of the impeller and its hub diameter.

In accordance with one of the embodiments of the gas boosting unit, the profile of the blades mounted in the inner and outer sections of the stator is determined depending on the profile of the impeller blades.

In accordance with one of the embodiments of the gas boosting unit the number of blades in the outer section of the stator is larger than the number of blades in the inner section of the stator.

One of the embodiments of the gas boosting unit provides that the cone angle of the exhaust cone is determined within a range from 2 to 25 degrees, depending on the ratio between the outer diameter of the impeller and its hub, and the distribution of the axial and tangential velocity of the flow along the radius of the blade.

In accordance with one of the embodiments of the gas boosting unit, the gas flow feeding channel may be performed in the shape of a confusor, with a smooth transition from a circular cross-section shape at the side of the feeding channel, which is connected to the stator, to a square or rectangular cross-section shape at the opposite side.

Aerodynamic separator for separating bulk mixtures, which employs the above-mentioned method and unit, has a housing, a feeder, a horizontal separation chamber with receivers of separated fractions and a gas boosting unit that comprises a housing, a drive, an impeller and a stator, characterized in that the stator has an inner conical ring installed coaxially with the impeller forming the inner and outer sections of the stator, profiled blades installed in the inner and outer sections of the stator and an exhaust cone, mounted in the center of the inner section of the stator coaxially with the impeller.

In accordance with one of the embodiments of the separator the mounting angle of the impeller axis to the horizontal plane may be in the range from 0 degrees to 60 degrees.

BRIEF DESCRIPTION OF THE DRAWINGS

For a better understanding of the present invention, reference is to be made to the accompanying drawings. It is to be understood that the present invention is not limited to the precise arrangement shown in the drawings.

DETAILED DESCRIPTION OF A PREFERRED EMBODIMENT

Figure 1:
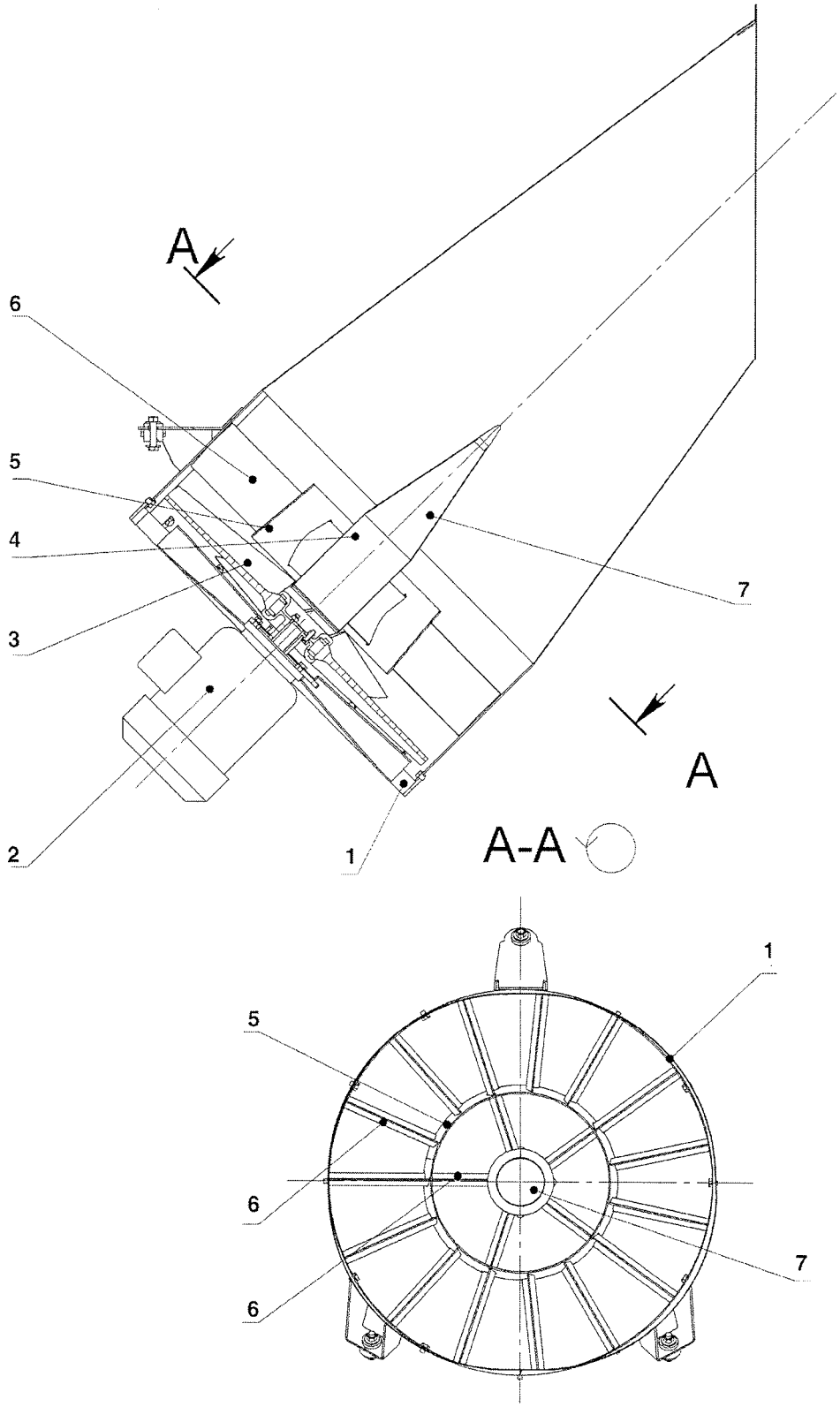
FIG. 1 illustrates the gas boosting unit of aerodynamic separator.

Turning to the drawings, the preferred embodiment is illustrated and described by reference characters that denote similar elements throughout the several views of the instant invention.

The preferred embodiment provides for a gas boosting unit of the aerodynamic separator (FIG. 1) comprises a housing 1, a coaxially mounted drive 2, an impeller 3 and a stator 4 with an inner conical ring 5, the profiled blades of the inner and outer sections 6, the exhaust cone 7.

Figure 2:
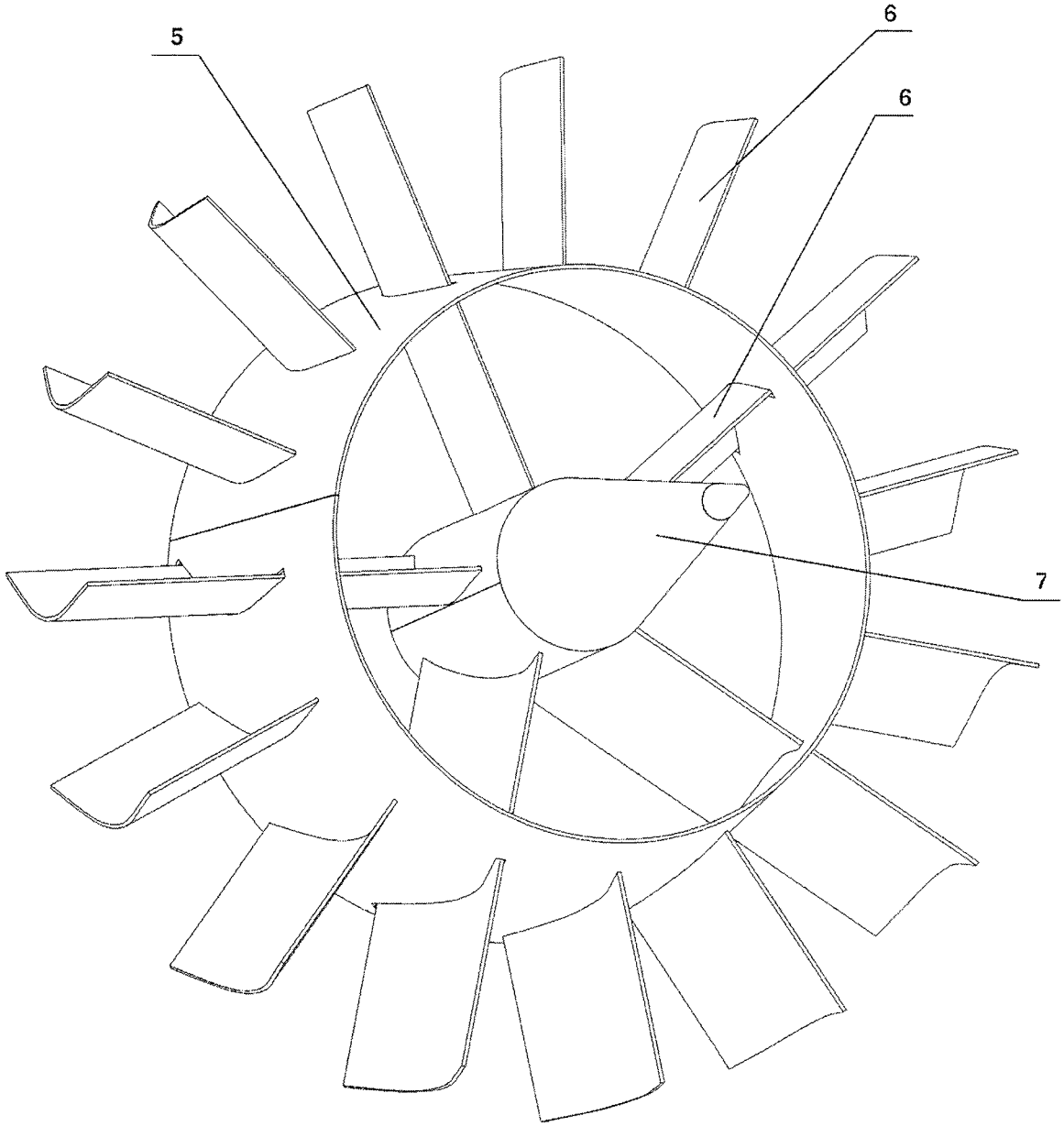
FIG. 2 illustrates the stator of the gas boosting unit of the aerodynamic separator.

The stator (FIG. 2) is a device comprising an inner conical ring 5, the blades of the inner and outer sections 6 and an exhaust cone 7.

Figure 3:
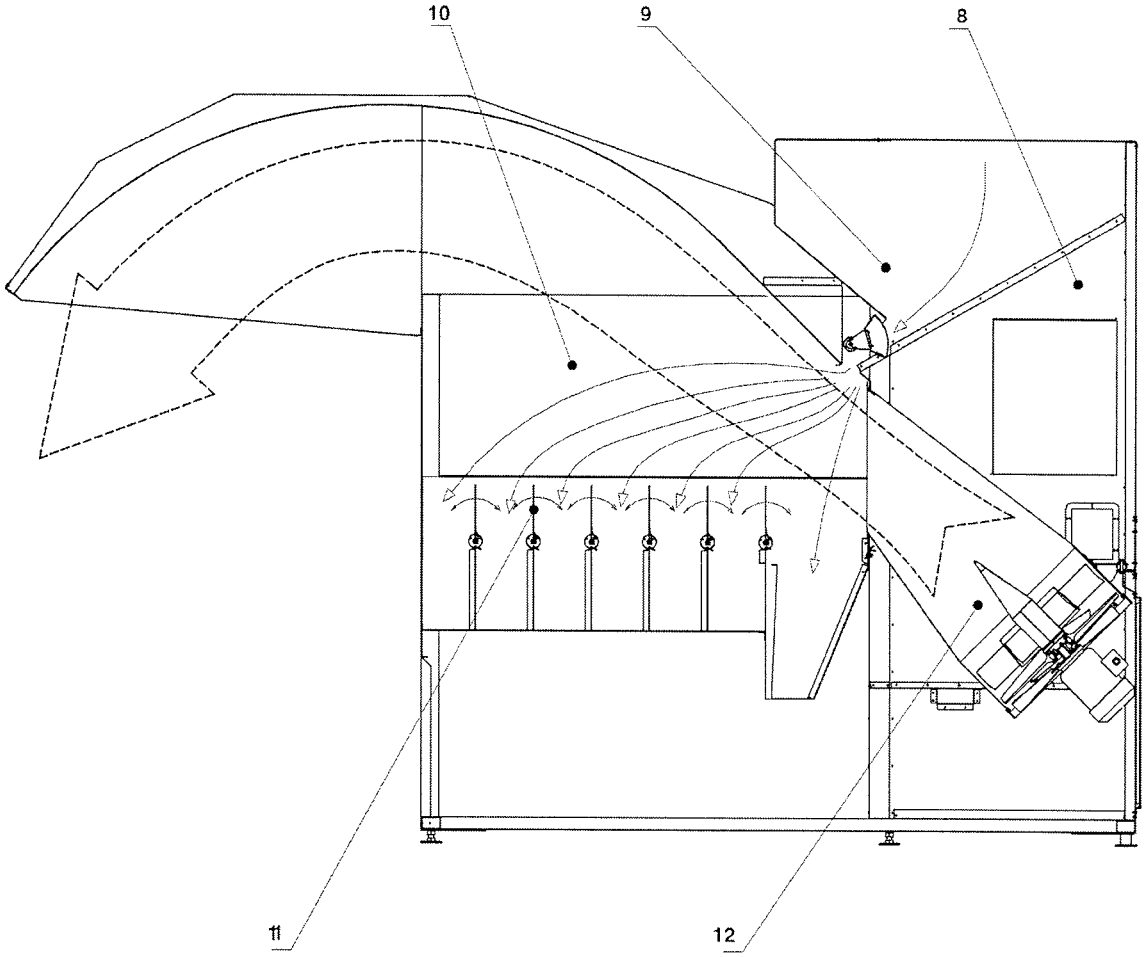
FIG. 3 illustrates the aerodynamic separator.

Aerodynamic separator (FIG. 3) is a device comprising a housing 8, a feeder 9, a separation chamber 10, receivers of separated fractions 11 and a gas boosting unit 12.

The operation principle of the gas boosting unit 12 of the aerodynamic separator is that the flow of gas or gas mixture is generated by rotation of the impeller 3 in an appropriate environment of gas or a gas mixture by means of the drive 2. As an example of the drive 2 FIG. 1 and FIG. 3 feature an electric motor, with impeller 3 mounted on its shaft. However, a drive may be represented by any type of power drive that uses any available form of energy and capable of producing the required torque and rotation speed.

The gas flow is aimed at the angle needed for the separation by setting the rotation axis of the impeller 3 at such desired angle.

In one embodiment of the method, the flow of gas or gas mixture is generated by the impeller 3 mounted at an angle to the horizontal plane in a range from 0 degrees to 60 degrees by setting the axis of the impeller 3 at a corresponding angle to the horizontal plane. This allows to aim the gas flow at the angle optimal for separation and eliminates the need to change the direction of gas flow by using special flow shapers used in known prototypes.

The conical ring 5, which forms the inner and outer sections of the stator 4 and has the shape of a nozzle, creates two sections with different cross-sectional area: outer section—between the conical ring 5 and the housing 1 of the gas boosting unit 12, the inner section—between the conical ring 5 and an exhaust cone 7.

The gas flow generated by the impeller 3, which is swirled, i. e. twisted in the direction of the rotation of the impeller 3 blades and has a non-uniform velocity of the gas or gas mixture across the cross-section of the flow, is divided into inner and outer flows by directing it through the inner and outer sections of the stator. This division of the gas flow makes it possible to have a different impact on the physical characteristics of inner and outer flows.

The gas flow in the inner and outer sections is straightened by converting the tangential component of flow velocity into the axial by passing the flow through the blades of the inner and outer sections 6 of the stator 4, thereby increasing the overall efficiency of the device. Profiled blades of the stator are installed as close as possible to the blades of the impeller.

Other embodiments of the device provide that the diameter of the base of the cone of the conical ring 5 is determined depending on the diameter of the hub and the outer diameter of the impeller 3, and that the angle of narrowing of the internal conical ring 5 is determined within the range of 2 to 25 degrees. This provides a uniform flow velocity over the entire cross-section.

Profiled blades 6 are mounted in the inner and outer sections of the stator 4 and are used to straighten the swirl of the gas flow generated by the impeller 3. Further, one of the embodiments of the device provides that the profile of the blades in the inner and outer sections 6 of the stator 4 is determined depending on the ratio between the axial and tangential velocity components of flow speed. This creates a more uniform flow and increases the overall efficiency of the device. In addition, another embodiment of the device provides that the number of blades 6 mounted in the inner and outer sections of the stator 4, should be different (more blades should be mounted in the outer section), which reduces the resistance to movement of gas through the inner section, with sufficient efficiency of the stator generally.

Exhaust cone 7, which has the shape of a cone with the apex directed towards the gas flow direction, is mounted in the center of the inner section of the stator 4 right behind of and coaxially with the hub of the impeller 3, prevents disruption of a flow behind the hub of the impeller 3 and reduces consumption of energy used for a gas blowing process. Another embodiment of the device provides that the cone angle of the exhaust cone 7 is determined within a range of 2 to 25 degrees depending on the angle of the cone of the conical ring 5, which provides a uniform velocity of the flow.

Thereby, the flow of gas or gas mixture, delivered at the outlet of the stator 4, is fed into the feeding channel linear, devoid of swirling and having uniform pressure and velocity across the whole cross-section.

Another embodiment of the device provides that the feeding channel may be performed in the form of a confuser, with a smooth transition from a round cross-section at the side of the supply channel which is connected to the stator, to a square or rectangular cross-section at the other side. This allows to shape the gas flow cross-section to rectangular or square shape, which is optimal for the passing through it bulk mixture which is to be separated into fractions.

The proposed device provides a significantly greater uniformity of velocities at all points of the gas flow cross-section. Maximum speed deviations are 5%. This was confirmed by computer simulations and actual measurements of the velocities in the working prototypes of the device.

Separator for separating bulk mixtures (FIG. 3) employing the above-described method and device, comprises housing 8 with the following constructional units installed in it: the gas boosting unit 12, the feeder 9, the separation chamber 10 and receivers of separated fractions 11.

Separation chamber 10 is mounted horizontally and is equipped with receivers of separated fractions.

The feeder 9 of the separator is performed in the form of a hopper, equipped with a device for dosing the feed mixture.

Gas boosting unit 12 of the separator is characterized in that it has a housing 1 with the following units installed in it sequentially: power drive 2, impeller capable of rotating 3, stator 4 and the gas flow feeding channel.

Typically, an electric motor with impeller 3 mounted on its shaft is used as a power drive. However, any other type of drive using any type of available energy can be used as a power drive 2 as long as it is capable of producing the required torque and rotation speed.

Stator 4 of the gas boosting unit 12 of the separator is characterized in that it comprises an internal conical ring 5 having the shape of a nozzle which narrows down towards gas flow direction and separates the stator into two sections—the inner and outer section, profiled blades 6 mounted in the inner and outer sections, and exhaust cone 7 installed coaxially with the impeller.

The gas flow feeding channel of the gas boosting unit 12 may be performed as a confuser with a smooth transition from a circular cross-section at the side of the supply channel, which is connected to the stator, to a square or rectangular cross-section at the side, which is connected to the separation chamber.

One of the embodiments of the apparatus, provides that the gas boosting unit 12 is mounted at an angle to the horizontal plane, so that the gas flow enters the separation chamber 10 at the desired angle without the need for additional flow shapers used in similar devices.

The novelties of the proposed device are the design of the gas boosting unit 12, the installation of the gas boosting unit at an angle to the horizontal plane and the absence of flow shapers.

The use of the inclined gas boosting unit, a smooth transition from a circular cross-section to a rectangular, the use of the profiled blades of the stator and the lack of gas flow shapers have significantly reduced the loss of the flow speed, which reduced energy consumption by 2-3 times.

The invention illustratively disclosed herein suitably may be practiced in the absence of any element which is not specifically disclosed herein.

The discussion included in this patent is intended to serve as a basic description. The reader should be aware that the specific discussion may not explicitly describe all embodiments possible and alternatives are implicit. Also, this discussion may not fully explain the generic nature of the invention and may not explicitly show how each feature or element can actually be representative or equivalent elements. Again, these are implicitly included in this disclosure. Where the invention is described in device-oriented terminology, each element of the device implicitly performs a function. It should also be understood that a variety of changes may be made without departing from the essence of the invention. Such changes are also implicitly included in the description. These changes still fall within the scope of this invention.

Further, each of the various elements of the invention and claims may also be achieved in a variety of manners. This disclosure should be understood to encompass each such variation, be it a variation of any apparatus embodiment, a method embodiment, or even merely a variation of any element of these. Particularly, it should be understood that as the disclosure relates to elements of the invention, the words for each element may be expressed by equivalent apparatus terms even if only the function or result is the same. Such equivalent, broader, or even more generic terms should be considered to be encompassed in the description of each element or action. Such terms can be substituted where desired to make explicit the implicitly broad coverage to which this invention is entitled. It should be understood that all actions may be expressed as a means for taking that action or as an element which causes that action. Similarly, each physical element disclosed should be understood to encompass a disclosure of the action which that physical element facilitates. Such changes and alternative terms are to be understood to be explicitly included in the description.

What is claimed is:

1. A method of providing an impeller-driven injection of gas in an aerodynamic separator comprising:

creating a flow of gas or gas mixture by impeller rotation;

straightening and aligning said gas or gas mixture flow by passing it through a stator;

feeding said gas or gas mixture flow into a stator, said stator having a conical ring and profiled blades;

feeding said gas or gas mixture into a separation chamber wherein said gas or gas mixture flow is created by the rotation of said impeller and is directed at an angle to said separation chamber by setting said impeller's axis of rotation at the appropriate angle to the horizontal plane;

wherein said flow of gas or gas mixture created by said impeller is divided into inner and outer flows by means of said stator's internal conical ring, which narrows towards said gas flow direction and forms inner and outer sections of the stator;

wherein said flow of gas or gas mixture is straightened in said stator's outer section by passing it through said profiled blades of said stator, and slowed due to increase of the cross-sectional area of said outer section;

wherein said flow of gas or gas mixture in said inner section is straightened by passing it through said profiled blades and accelerated to a speed equal to the flow speed in said outer section by reducing the inner cross-sectional area of said conical ring and using an exhaust cone, located in the center of said stator coaxially with said impeller.

2. The method as defined in claim 1 wherein said flow of gas or gas mixture is generated by said impeller, the axis of which is located at an angle to the horizontal plane in a range from 0 degrees to 60 degrees.

3. The method as defined in claim 1 wherein the cross-sectional shape of said straightened and aligned flow of gas or gas mixture is changed from round to square or rectangular, by directing it through a channel having a shape of a confuser with a smooth transition from a round cross-section at the end connected to said stator, to square or rectangular shape at the end where said flow of gas or gas mixture exits a boosting unit.

4. A gas boosting unit of an aerodynamic separator comprising:

a housing;

a drive;

a working unit further comprising:

an impeller having a hub and a certain radius to said impeller and a certain radius to said hub;

a stator and;

a gas flow supply channel wherein said stator further comprises an inner conical ring installed coaxially with said impeller and narrowed in the direction of gas flow, which forms inner and outer sections of said stator;

profiled blades having a certain radius installed in said outer and inner sections of said stator and;

an exhaust cone, installed in the center of said inner section coaxially with said impeller.

5. The gas boosting unit as defined in claim 4 wherein the number of blades in said outer section of said stator is larger than the number of blades in said inner section of said stator.

6. The gas boosting unit as defined in claim 4 wherein a gas flow supplying channel is designed as a confusor, which has a round shape cross-section at the end connected to said stator which smoothly transitions into a square or rectangular-shaped cross-section at the opposite side of said channel.

7. An aerodynamic separator for separation of bulk mixtures, comprising:

a housing;

a feeder;

a horizontal separation chamber;

receivers of separated fractions and;

a gas boosting unit further comprising:

a housing;

a drive;

an impeller and;

a stator wherein said stator has an inner conical ring mounted coaxially with said impeller and forming the inner and outer sections of said stator;

profiled blades installed in said inner and outer sections of said stator, and;

an exhaust cone located in the center of said inner section, installed coaxially with said impeller.

8. The aerodynamic separator as defined in claim 7 wherein the angle of the impeller axis to the horizontal plane may be set in the range of 0 degrees to 60 degrees.

* * * * *